US009227455B2

(12) United States Patent
Peleman

(10) Patent No.: US 9,227,455 B2
(45) Date of Patent: Jan. 5, 2016

(54) ELEMENT FOR MAKING A PRESENTATION MEANS

(75) Inventor: Guido Peleman, Antwerp (BE)

(73) Assignee: UNIBIND LIMITED, Nicosia (CY)

( * ) Notice: Subject to any disclaimer, the term of this patent is extended or adjusted under 35 U.S.C. 154(b) by 1018 days.

(21) Appl. No.: 13/386,753

(22) PCT Filed: Jun. 29, 2010

(86) PCT No.: PCT/IB2010/001590

§ 371 (c)(1),
(2), (4) Date: Jan. 24, 2012

(87) PCT Pub. No.: WO2011/012941

PCT Pub. Date: Feb. 3, 2011

(65) Prior Publication Data

US 2012/0119480 A1 May 17, 2012

(30) Foreign Application Priority Data

Jul. 30, 2009 (BE) ..... 2009/0462

(51) Int. Cl.

| | |
|---|---|
| ***B42D 5/00*** | (2006.01) |
| ***B42D 5/04*** | (2006.01) |
| ***G09D 3/02*** | (2006.01) |

(52) U.S. Cl.

CPC ..... *B42D 5/043* (2013.01); *B42D 5/047* (2013.01); *G09D 3/02* (2013.01)

(58) Field of Classification Search

CPC ..... B42F 1/00; B42F 1/12; B42F 3/04; B42F 3/06; B42F 11/00; B42F 11/02; B42F 13/02; B42F 13/04; B42F 13/06; B42F 13/0066; B42F 13/0073; B42F 13/008; B42F 5/06; B42D 1/004; B42D 1/08; B42D 1/10; B42D 5/027; B42D 5/047; B42D 5/043; G09D 3/02

USPC ..... 281/19.2, 27.1, 27.2, 27.3, 28, 36, 20, 281/21, 34, 43; 40/119, 120, 121; 402/21, 402/58; 412/18, 19, 25, 28; 140/92.3, 92.94

See application file for complete search history.

(56) References Cited

U.S. PATENT DOCUMENTS

| | | | | |
|---|---|---|---|---|
| 2,787,853 | A | 4/1957 | Nichols | |
| 2,883,792 | A | 4/1959 | Marano | |
| 4,157,842 | A * | 6/1979 | Silver | 281/38 |
| 5,062,229 | A * | 11/1991 | Werjefelt | 40/107 |
| 6,036,423 | A * | 3/2000 | Westra | B42B 5/123 412/38 |
| 2007/0196162 | A1 * | 8/2007 | Hasegawa et al. | 402/70 |

FOREIGN PATENT DOCUMENTS

| | | | |
|---|---|---|---|
| DE | 20 2006 015171 | U1 | 12/2006 |
| FR | 2 207 465 | A | 6/1974 |

OTHER PUBLICATIONS

International Search Report, dated Oct. 19, 2011, from corresponding PCT application.

* cited by examiner

*Primary Examiner* — Matthew G Katcoff
(74) *Attorney, Agent, or Firm* — Young & Thompson

(57) ABSTRACT

An element (13) for making a flip-over presentation unit (1), shaped by a bundle of strips of material (2) provided with an adhesive strip (5) onto which sheets (15) can be adhered, which strips of material (2) are provided with holes (4) through which at least one binding spiral (3) is passed, wherein the element (13) is provided with a rigid support (14) in which the binding spiral (3) is fixed, wherein the width of the support (14) corresponds mainly to the width of the sheets (15), wherein the binding spiral (3) is fixed to the support (14) by detachable parts (19) provided with toothings (26) extending between the coils of the binding spiral (3), wherein the support (14) is provided with alignment members (12) to align the sheets (15) with respect to the strips of material (25).

18 Claims, 5 Drawing Sheets

ELEMENT FOR MAKING A PRESENTATION MEANS

The present invention relates to an element for making a flip-over presentation means.

More particularly, the invention is intended for a presentation means of the type which is provided with sheets tied at one edge by means of a binding coil.

BACKGROUND OF THE INVENTION

Presentation means made in the form of a hanging or self-standing calendar, for example, are known, in which the calendar contains a set of printed strips on which the days of the month, and optionally text, photographs, images and the like, are applied, and whereby the sheets of this calendar are flipped backwards at the end of a month in order to make the next sheet with the next month visible.

A drawback of these classic calendars is that they are impersonal given that the optional images are pre-printed.

Calendars are also known in which all the sheets, with the exception of the last one, are provided with a window, whereby a photograph can be placed on this last sheet at the same height as the window in the previous sheets.

A drawback of those calendars is that the same photograph is seen for a long time period and that the photograph, for example, cannot be adapted over the months according to the seasons or other preferences of the user.

Furthermore, also photographic albums are known in the form of a bundle of tied sheets in which photographs can be inserted in a removable or non-removable manner.

A drawback is that the photographs usually come loose or can slide out of them.

Furthermore, these photographic albums are very cumbersome to use given that the sheets have, over nearly their entire surface, a layer of self-adhesive glue onto which the user must place the photographs and then a transparent film is placed on the sheet.

The drawback of said films is that they can become loose over time, and this will be enhanced if creases or dog's ears arise at the edges of the sheets.

Another drawback is that the layer of glue may be discoloured over time, which will give the photographic album an unaesthetical and non-professional look.

Another drawback of known photograph albums is that they cannot be used as a decorative element such as, for example, in the shape of an element which can be fixed to the wall or placed on a table or cabinet.

SUMMARY OF THE INVENTION

The objective of the present invention is to offer a solution for one or more of the drawbacks mentioned above and/or other drawbacks, in that it provides an element for making a flip-over presentation means consisting of a bundle of strips of material provided with an adhesive strip onto which sheets can be adhered for making a bundle, which strips of material are provided along one edge with holes through which at least one binding spiral is passed, which binding coil is secured on a rigid support the width of which corresponds mainly to the width of the strips to be placed, and the binding coil is fixed to the support by means of detachable parts of the support, hereby these detachable parts are provided with toothings which are extended between the coils of the binding spiral and whereby the support is provided with alignment means which, during the adhesion, allow to align the sheets with respect to the strips of material.

An advantage is that the presentation means is fixed to the element, and such that a firm assembly arises.

An advantage related to the above is that the presence of a rigid support offers a protection for the presentation means since the chances are reduced that the photographs included in the presentation means get damaged due to creasing, rolling up or the like in the event of careless handling.

An advantage is that the presentation means with the support according to the invention is easy to manufacture.

According to a particular feature of the invention, the element is provided with alignment means, and such that when manufacturing the presentation means the photographs can be aligned with respect to the support.

An advantage is that the application of the element does not require extreme care by the user in order to obtain an aesthetic result, given that as a result of the alignment means provided the photographs or sheets to be adhered will automatically be correctly positioned.

According to a preferred feature of the invention, the rigid support may be realised as a frame shaped element.

An advantage is that the element with the presentation means can be hung on the wall as a frame or it can be placed as a frame on a table, or a cabinet or the like.

An additional advantage is that the user may choose whether or not to remove the support, given that the binding spiral is fixed to the element by means of detachable parts.

When the support is not removed, the alignment means may serve as a support for the sheets and/or photos adhered to the strips such that the holes of the strips suffer less under the weight of the photographs introduced when the presentation means is hung.

Furthermore, in this embodiment the support can also be provided with fixing means for hanging the support with the presentation means on the wall, for example, in the shape of an extendable arm in the rear part of the support.

In the most practical embodiment of the invention, the detachable part of the support is provided in the shape of a protrusion with a toothing and in the upper part of the support there is a recess, whereby a space is provided between the teeth and the bottom of this recess.

It is evident that it is preferable to provide the presentation means with longitudinal and lateral alignment means.

According to a preferred feature of the invention, the alignment means are made in the form of raised edges on the support, of which at least one raised edge extends itself longitudinally and at least one raised edge extends itself laterally at the edge of the support across the binding spiral.

An advantage is that several sheets and/or photos which are intended to be adhered on the adhesive strips may be aligned by simply placing the sheets and/or photos on or against the stops.

In another embodiment of the invention, the alignment means may also be made as individual elements fixed to the support.

In such an embodiment, it is possible to place or remove from the support the alignment means as desired.

In a practical embodiment of the invention, the support is mainly a smooth and rectangular plate provided with one or more stops for the alignment of the photographs or sheets which are to be placed, and these stops extend transversely on the plane of the plate and along the lengthwise and widthwise direction of the plate.

BRIEF DESCRIPTION OF THE DRAWINGS

For the purpose of better showing the features of the invention, a preferred embodiment of an element for making a presentation means according to the invention will be described below as an example, but without being limited thereto, with reference to the attached drawings in which:

FIG. 3 depicts an exploded view of the element and of the presentation means;

DETAILED DESCRIPTION OF THE PREFERRED EMBODIMENTS

Figure 1:
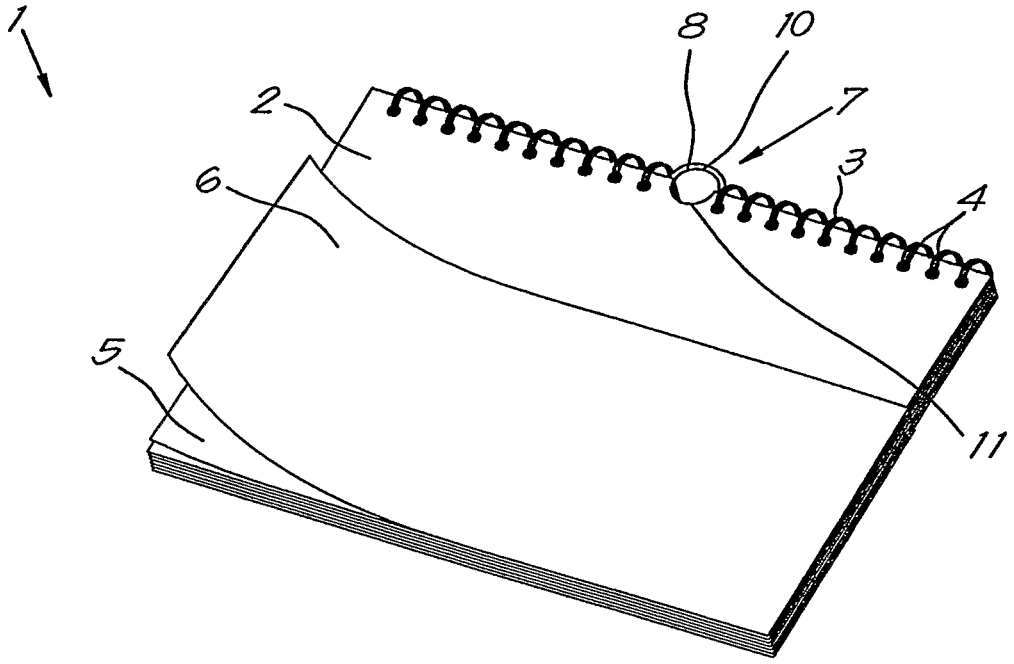
FIG. 1 depicts a schematic perspective view of a presentation means which may be made by means of an element according to the invention.

FIG. 1 schematically depicts a presentation means 1, and the presentation means 1 is made in the form of a bundle of strips of material 2 which are tied at one edge by means of a binding spiral 3 extending at least partially over the length of this side edge.

In the reproduced example, the strips of material 2 are made in the shape of sheets, of paper or cardboard, for example. However, the strips of material 2 may also be made of a transparent material.

The strips of material 2 are bound over the entire width by means of the binding spiral 3 and for this purpose each strip 2 is provided in the upper edge with a row of equidistant perforations 4 through which the binding spiral 3 extends itself.

In the reproduced example, the width of the strips of material 2 is smaller than the length of these strips 2, but this is not a requirement for the invention.

According to the invention, these bound strips of material 2 are furthermore provided with at least one adhesive strip 5 containing a self-bonding adhesive and on which a removable cover film 6 is preferably placed.

In the reproduced example of the figures, this adhesive strip 5 is close to the unbound end of the strip of material 2, but this is not strictly necessary according to the invention.

In the reproduced example, the adhesive strip 5 is executed as one continuous strip, but is clear that the adhesive strip 5 can also be divided into several smaller adhesive strips.

The objective of the adhesive strip 5 is to provide the strips of material 2 with photos or images and to thus realise a customised presentation means 1, such as a customised calendar.

In a practical embodiment of the presentation means, hanging means 7 for fixing the presentation means 1 to a wall or the like are included.

In their simplest form, these hanging means 7 are made by placing a bent wire 8 in the binding spiral 3.

Said wire 8 is bent in an omega shape and consists of two straight legs 9 placed in the coils of the aforementioned binding coil 3 and a curved part 10 between the aforementioned legs, with which the presentation means can be hung on a hook or the like.

In the embodiment shown, the strips of material 2 are provided with a recess 11, such that when the hanging means 7 are not used, the curved part 10 may be stored embedded in the presentation means 1 so that it does not form a protruding element at the edge of the presentation means 1.

In a variant of a presentation means 1 which is not shown, one of the strips of material 2 may be executed in the shape of a more rigid A4-sized end sheet, for example, such that this end sheet simplifies the alignment of images in the strips of material 2, in that the edges of the images or photos can be juxtaposed with the edges of this end sheet.

In a practical embodiment of the invention, the means 12 simplifying the alignment of the images are made in the shape of an additional element 13 for making the presentation means 1.

To that end, the presentation means 1 or the bound bundle of sheets may be removably fixed with respect to the element 13, and such that after manufacturing the presentation means 1, the user may detach the element 13 from the presentation means 1, given that the alignment means 12 are no longer useful.

Figure 2:
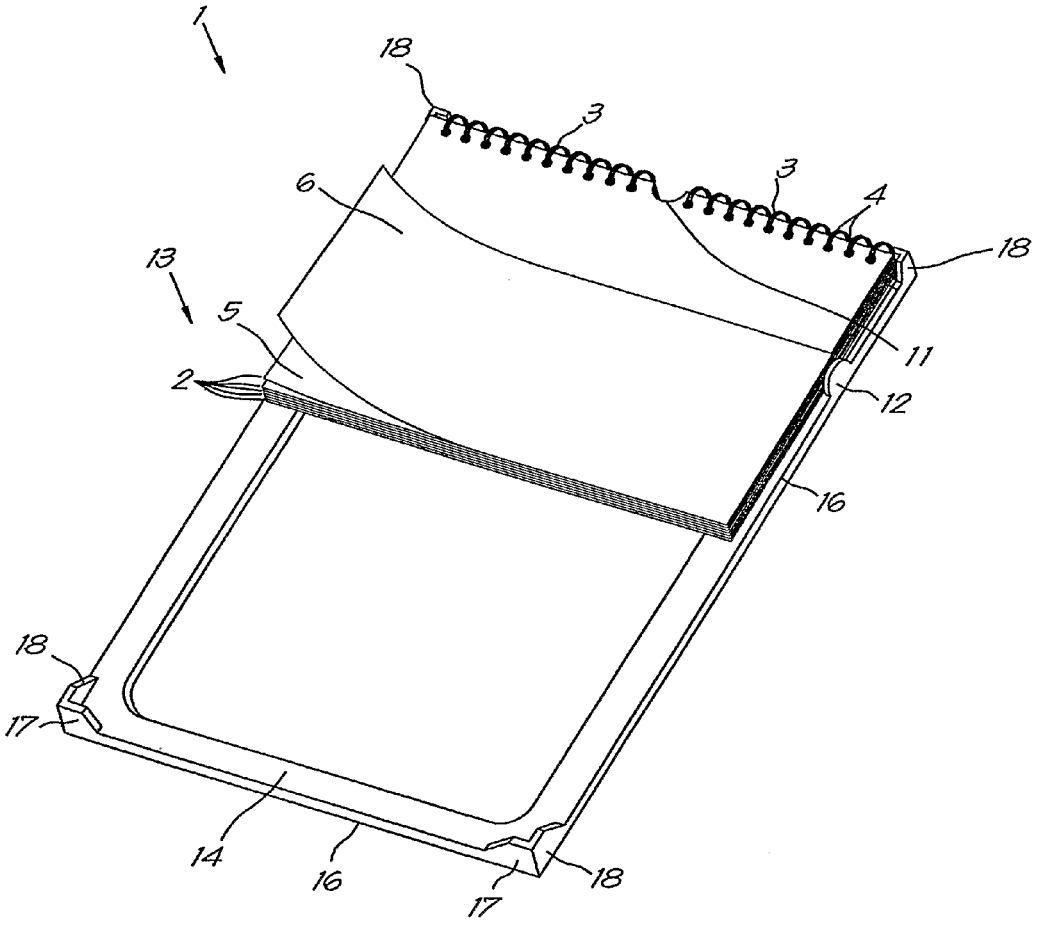
FIG. 2 depicts a schematic perspective view of the element according to the invention with the presentation means of FIG. 1.

This element 13 according to the invention for making the presentation means 1 is depicted in detail in FIGS. 2 and 3.

The element 13 contains a rigid support 14 which may be executed in the shape of a rectangular plate and which, for example, may be manufactured from a hard synthetic material, of from wood or the like.

To simplify the alignment of photos and images 15, there are placed one or more stops, at the edges 16 of the support 14 more particularly in the shape of raised edges 17 on the support 14.

In the reproduced embodiment of FIG. 2, such raised edges 17 are located in the corners 18 of the support 14.

In another embodiment of the invention, the raised edges 17 may be applied not only in the corners 18, but also on a part of or on the entire length of one or more circumferential sides 16.

In the reproduced embodiment, the raised edges 17 at the lower edge of the support 14 have larger dimensions than those at the upper edge of the support 14.

It is clear that the upper edge or edges 17 allow aligning the sheets, photos or the like 15 in a simple manner, by simply placing the photos or sheets 15 between the raised edges 17 or to let them be supported by the edges.

According to the invention, the support 14 is further provided with detachable parts 19 which are located at the upper edge 20 of the support 14 in the depicted shape.

Figure 5:
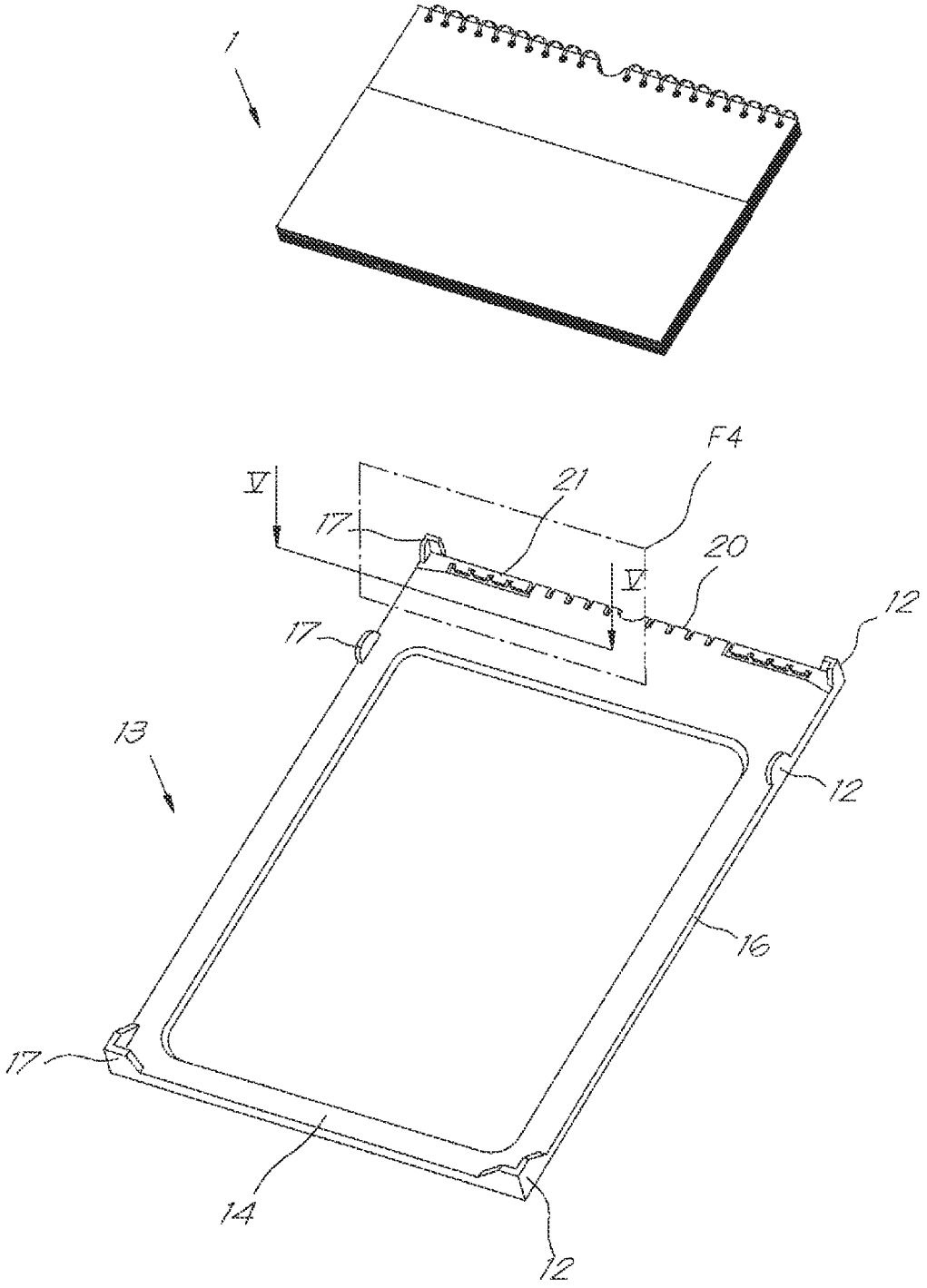
FIG. 5 depicts a section according to line V-V in FIG. 3.
Figure 4:
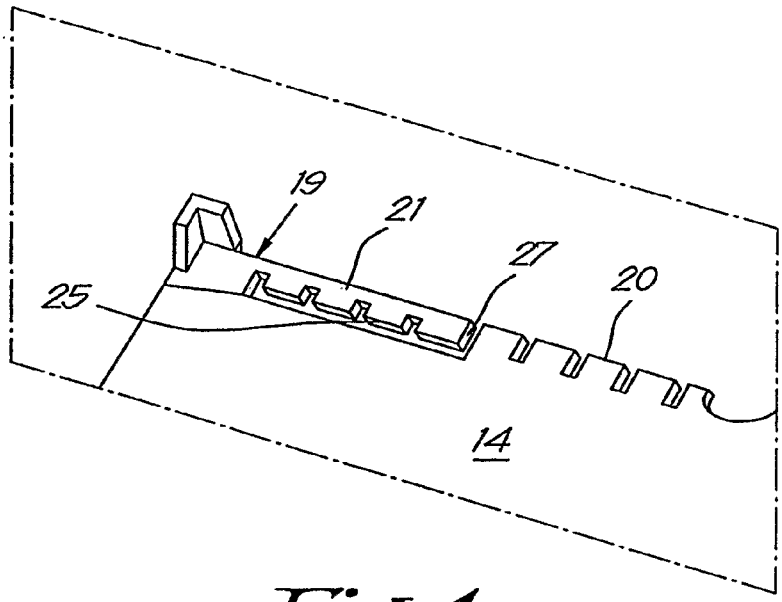
FIG. 4 depicts an enlarged reproduction of the detail indicated in FIG. 3 with arrow F4.
Figure 5:
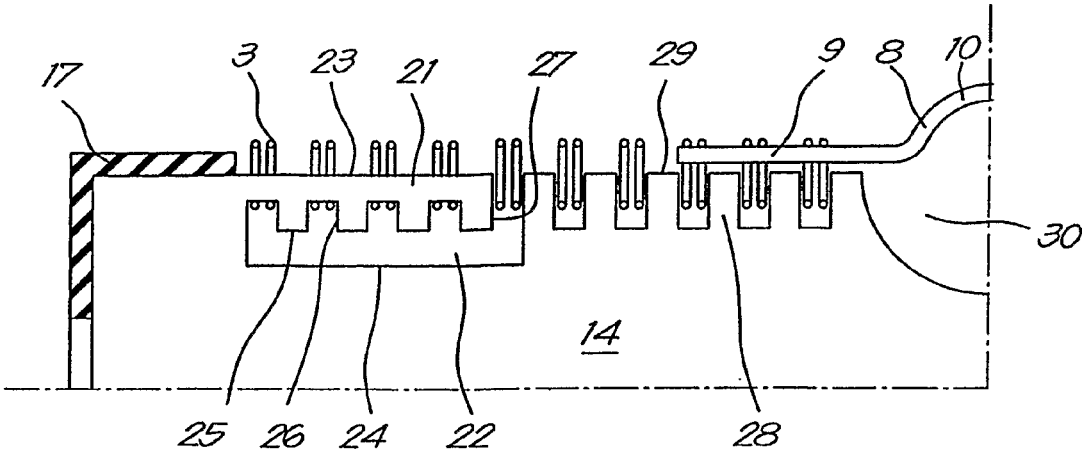

This detachable part 19 preferably consists of a protrusion 21, which is depicted in more detail in FIGS. 4 and 5.

In the preferred embodiment of the invention, this protrusion 21 forms part of the upper edge 20 of the rigid support 14.

To that end, there are two recesses 22 at the upper edge 20 of the support 14, and they are placed such that the upper edge 23 of the protrusion 21 forms the upper edge 20 of the support 14 and that there is a certain distance between the bottom 24 of the recess 22 and the protrusion 21.

The protrusion 21 is preferably provided, on the side 25 oriented to the bottom 24 of the recess 22, with a toothing 26, whereby the size of the teeth is chosen such that the teeth never touch the bottom 24 of the recess 22.

In the reproduced embodiment, the element 13 is provided, both on the left- and the righthand side, with a similar protrusion 21, whereby both protrusions 21 have the same length and are oriented towards one another with their free ends 27, but this is not a requirement according to the invention.

In a practical embodiment of the invention, the pitch of the binding spiral 3 of the presentation means 1 is identical to or almost identical to the pitch of the toothing 26 in the protrusion 21, as is shown clearly in FIG. 5.

According to a preferred feature of the invention, the length of each protrusion 21 and the length of the recess in the upper edge 20 are smaller than half the width of the support 14, so to leave a free space around the centre of the upper edge 20.

In said part 28 of the upper edge 20 between the ends 27 of both protrusions 21, there is also preferably placed a fixed toothing 29, the pitch of which also corresponds to the pitch of the binding spiral 3.

In the shown example, the toothing 29 in the aforementioned part 28 is interrupted at the centre of the upper edge 20.

In this example, furthermore, around the centre of the upper edge 20, a recess 30 is worked out in the upper edge 20 of the support 14.

In a practical embodiment of the invention, this recess 20 has a circular shape the dimensions of which are such that the hanging element 7 can be embedded inside.

The method for manufacturing a presentation means 1 by means of an element 13 according to the invention is very simple and is pershapeed as follows.

In a first step, the user may remove the cover film of the adhesive strip 5, after which the user may introduce in a simple manner photos, sheets 15 or the like on the adhesive strip 5 which is freed on the strip of material 2 concerned.

As a result of the presence of the alignment means 12 in the element 13, it is simple to position the edge of the photo or image 15 such that there is no horizontal deviation between the edge of the strip of material 2 and the edge of the applied photo 15.

After introducing a photo 15 in the first strip of material 2, the sheet made may be easily turned half a turn such that the next strip of material 2 is at the top and a photo 15 can be adhered on it.

Figure 6:
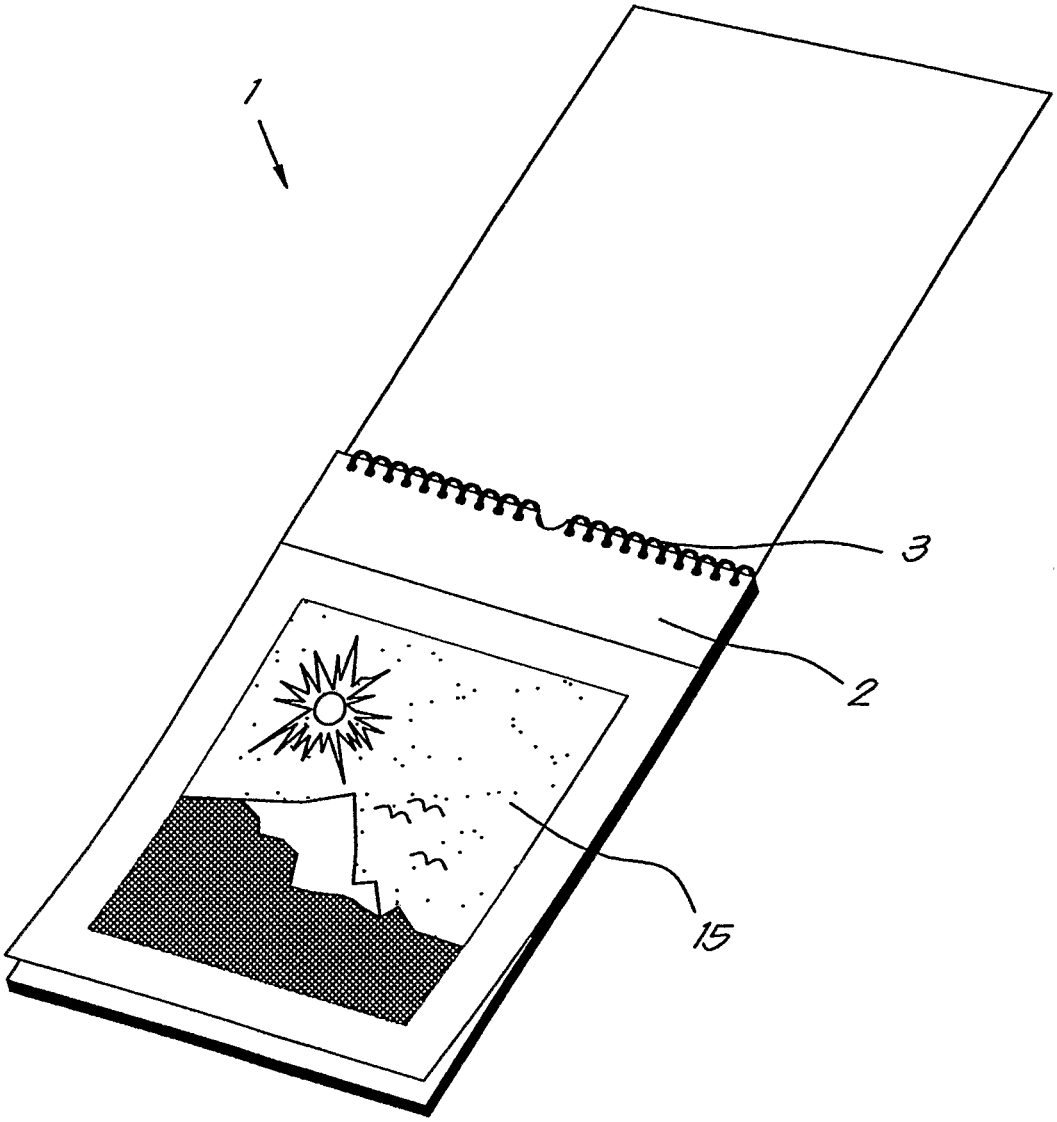
FIG. 6 depicts the presentation means made.

After all the photos 15 are placed on all the strips of material 2, the user has the possibility to detach the presentation means 1 from the support 14 by breaking the protrusions 21, after which the presentation means 1 is obtained, as shown in FIG. 6.

There is also the possibility not to remove the protrusions 21, such that the element 13 forms a frame for the presentation means 1, and to hang the frame made on a wall or the like or to place it on a table or cabinet.

According to a variant of the invention, to that end the support 14 can be provided with support elements not shown in the figures, in the shape of an extendable arm or the like at the rear side of this support 14, for example.

In another variant of the invention, the support 14 may be made as a disposable element and the presentation means 1 made will be applied on a wall or the like by means of the attached hanging means 7.

According to a variant of the invention which is not shown, the strips of material 2 may have an adhesive strip on both sides, both of which will have a removable cover film 6.

In this embodiment, the user may place a photo or image 15 on both sides and the presentation means 1 made may be used on both sides.

The present invention is by no means limited to the embodiments described as an example and depicted in the drawings, but rather an element according to the invention for making a presentation means may be made in any shape and dimension without thus departing from the scope of the invention.

The invention claimed is:

1. An element (13) for making a flip-over presentation means (1) formed by a bundle of strips of material (2), provided with an adhesive strip (5) onto which sheets (15) can be adhered for making a bundle, and provided along one edge with holes (4) through which at least one binding spiral (3) is passed, the element (13) comprising:

a rigid support (14) configured such that the binding spiral (3) is fixable thereto, the width of the support (14) corresponding to the width of the sheets (15) to be placed therein, the support (14) including detachable parts (19) configured such that the binding spiral (3) of the presentation means (1) may be fixed thereto, said detachable parts (19) being provided with toothings (26) located such to extend between coils of the binding spiral (3), and the support (14) also including alignment means (12) configured to align the sheets (15) of the presentation means (1) with respect to the strips of material of the presentation means (1).

2. The element (13) according to claim 1, wherein the alignment means (12) align the sheets (15) with respect to both a length and a width of the sheets (15).

3. The element (13) according to claim 1, wherein the alignment means are provided (12) at both lengthwise and widthwise positions on the support (14).

4. The element (13) according to claim 1, wherein the alignment means (12) comprise raised portions located at edges of the support (14).

5. The element (13) according to claim 1, wherein the alignment means (12) comprise raised portions at edges (17) of the support (14) at least at the corners (18) of the support (14).

6. The element (13) according to claim 1, wherein the alignment means (12) is located at an edge of the support (14) along which the spiral (3) is fixed.

7. The element (13) according to claim 1, wherein the detachable parts (19) include corners (18) configured to align the bundle of strips of material.

8. The element (13) according to claim 1, wherein the detachable part includes a protrusion (21), a first side (23) of the protrusion (21) forming a part of an upper edge (20) of the rigid support (14), and an opposite second side (25) of the protrusion (21) provided with toothings (26) located in a recess (22) running along a direction of the upper edge (20).

9. The element (13) according to claim 8, wherein there is a distance between the teeth of the protrusion (21) and a bottom (24) of the recess (22).

10. The element (13) according to claim 1, wherein a center of an upper edge (20) of the rigid support (14) forms a gap with a width that corresponds to a distance between two binding spirals (3) for forming a hanging element (7) of the presentation means (1) for hanging the presentation means (1).

11. The element (13) according to claim 10, wherein the hanging means (7) comprises a metal wire (8) bent to form two straight legs (9) connected by a curved part (10), the straight legs (9) of the hanging element (7) extending longitudinally in the two aforementioned spirals (3).

12. The element (13) according to claim 10, wherein the support (14) includes recesses in which the hanging element (7) can be stored.

13. The element (13) according to claim 1, wherein the upper edge (20) of the support (14) is provided with fixed toothings (29).

14. The element (13) according to claim 1, wherein the support (14) is shaped as a frame configured to be any of hung on a wall or placed on a table.

15. The element (13) according to claim 1, wherein the support (14) further includes support elements.

16. The element (13) according to claim 1, wherein the support (14) is made as a disposable element.

17. An element (13) for making a flip-over presentation means (1) formed by a bundle of strips of material (2), provided with an adhesive strip (5) onto which sheets (15) can be adhered for making a bundle, and provided along one edge with holes (4) through which at least one binding spiral (3) is passed, the element (13) comprising:

a rigid support (14) configured such that the binding spiral (3) is fixable thereto, the width of the support (14) corresponding to the width of the sheets (15) to be placed therein, the support (14) including detachable parts (19) configured such that the binding spiral (3) of the presentation means (1) may be fixed thereto, said detachable parts (19) being provided with toothings (26) located such to extend between coils of the binding spiral (3), and the support (14) also including alignment means (12) configured to align the sheets (15) of the presentation means (1) with respect to the strips of material of the presentation means (1), wherein the alignment means (12) comprise raised portions at edges (17) of the support (14) at least at the corners (18) of the support (14).

18. An element (13) for making a flip-over presentation means (1) formed by a bundle of strips of material (2), provided with an adhesive strip (5) onto which sheets (15) can be adhered for making a bundle, and provided along one edge with holes (4) through which at least one binding spiral (3) is passed, the element (13) comprising:

a rigid support (14) configured such that the binding spiral (3) is fixable thereto, the width of the support (14) corresponding to the width of the sheets (15) to be placed therein, the support (14) including detachable parts (19) configured such that the binding spiral (3) of the presentation means (1) may be fixed thereto, said detachable parts (19) being provided with toothings (26) located such to extend between coils of the binding spiral (3), and the support (14) also including alignment means (12) configured to align the sheets (15) of the presentation means (1) with respect to the strips of material of the presentation means (1), wherein a center of an upper edge (20) of the rigid support (14) forms a gap with a width that corresponds to a distance between two binding spirals (3) for forming a hanging element (7) of the presentation means (1) for hanging the presentation means (1), and wherein the support (14) includes recesses in which the hanging element (7) can be stored.

* * * * *